United States Patent [19]

Lebet

[11] 4,436,517

[45] Mar. 13, 1984

[54] APPARATUS FOR MAKING TRANSVERSE FLOW CIGARETTE FILTERS

[75] Inventor: Jean-Pierre Lebet, Montreux, Switzerland

[73] Assignee: Baumgartner Papiers S.A., Renens, Switzerland

[21] Appl. No.: 20,471

[22] Filed: Mar. 14, 1979

Related U.S. Application Data

[63] Continuation-in-part of Ser. No. 839,607, Oct. 5, 1977, Pat. No. 4,164,438.

[30] Foreign Application Priority Data

Oct. 5, 1976 [CH] Switzerland ..... 12568/76

[51] Int. Cl.[3] ..... A24C 5/50

[52] U.S. Cl. ..... 493/45; 425/297; 425/304; 425/385; 425/392; 493/42; 493/43; 493/49

[58] Field of Search ..... 425/297, 237, 343, 304, 425/385, 392; 493/42, 43, 45, 49

[56] References Cited

U.S. PATENT DOCUMENTS

| | | | |
|---|---|---|---|
| Re. 29,674 | 6/1978 | Labbe et al. | 264/151 |
| 2,954,773 | 10/1960 | Lebet | 264/151 |
| 3,093,142 | 6/1963 | Swerdloff | 131/268 |
| 3,164,242 | 1/1965 | Schubert et al. | 93/1 C |
| 3,164,243 | 1/1965 | Rudszinat et al. | 93/1 C |
| 3,805,682 | 4/1974 | Lyon et al. | 93/1 C |
| 3,958,498 | 5/1976 | Payne | 493/42 |
| 4,149,546 | 4/1979 | Luke et al. | 425/383 |
| 4,292,032 | 9/1981 | Luke | 493/43 |

*Primary Examiner*—James H. Derrington

*Attorney, Agent, or Firm*—Robert E. Burns; Emmanuel J. Lobato; Bruce L. Adams

[57] ABSTRACT

In apparatus for making transverse-flow cigarette filters, a rod of cellulose acetate impregnated with a plasticizing agent and having a porous covering is cut into sections each having a length of several filters. From the cutting station, the rod sections are fed longitudinally into longitudinal grooves in the periphery of a first revolving drum. The rod sections are then transferred into longitudinal grooves in the periphery of a second revolving drum having in such grooves projections for forming indentations in one side of the rod sections. While carried by the second revolving drum, the rod sections are engaged by a third revolving drum having on its periphery projections for forming longitudinally offset indentations in the opposite side of the rod sections. In another embodiment of the apparatus, the rod sections are received in transverse grooves in a conveyor belt, and are transferred in groups between opposed punches which form indentations in opposite sides of the rod sections.

11 Claims, 13 Drawing Figures

FIG.5
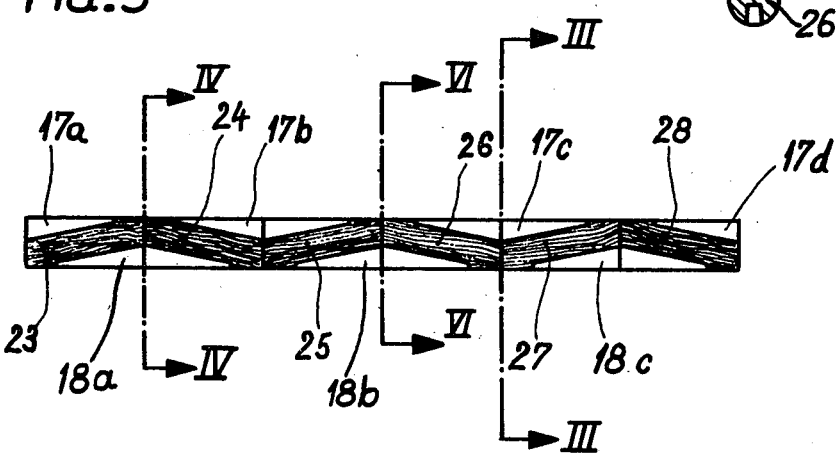
FIG.6
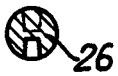
FIG.8
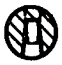
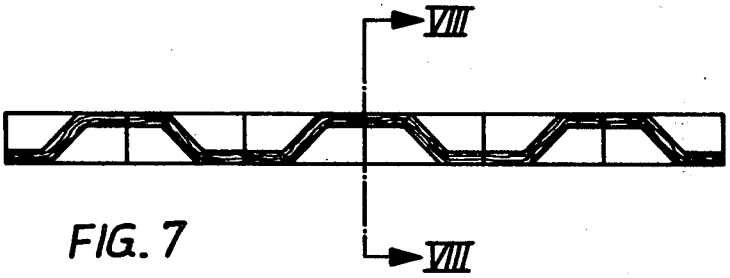
FIG. 7
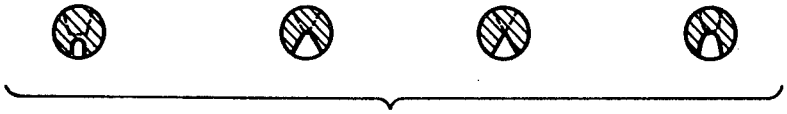
FIG.9

APPARATUS FOR MAKING TRANSVERSE FLOW CIGARETTE FILTERS

REFERENCE TO PRIOR APPLICATION

This application is a continuation-in-part of application Ser. No. 839,607 filed Oct. 5, 1977 now U.S. Pat. No. 4,164,438.

FIELD OF INVENTION

The present invention relates to apparatus for the manufacture of a filtering member of cellulose acetate for cigarette filters of the type having a transverse flow, known under the name of "cross-flow" filters, i.e. comprising at least one filtering part extending obliquely and transversely with respect to the body of the filter in order to form at least two chambers separated by the filtering member, according to which the cellulose acetate previously impregnated with a plasticising agent is pressed and shaped when hot and from which a bunch or rod is formed on which a porous skin has been formed or which has been wrapped in a porous paper.

BACKGROUND OF THE INVENTION

A filter of the "cross-flow" type is described in U.S. Pat. No. 3,533,416. Its advantages reside in a substantially higher power of retention than normal filters, without a pressure drop. A device for the shaping of such filtering members is described in U.S. Pat. No. 3,826,177. In this device, the rod of cellulose acetate, previously coated with a plasticizing agent and heated by means of water vapor, passes between a set of shaping wheels, then it is cut into filter sections. Since cutting takes place after shaping of the members, it is necessary that the cut occurs exactly between successive members, which requires very accurate synchronization of the shaping members and cutting members and an absolutely uniform feed of the rod. If these conditions are not satisfied, even momentarily, this results in waste which may be very considerable.

SUMMARY OF THE INVENTION

The precise object of the present invention is to prevent the formation of waste due to faulty synchronization, thus making the cut independent of the shaping process, which also makes it possible to simplify the control arrangement. To this end, one makes use of the fact that approximately 15 to 20 minutes are available for a shaping operation, at ambient temperature, between plasticization of the cellulose acetate and its solidification. The method of manufacture of a filtering member according to the invention is characterized in that the cellulose acetate rod is firstly cut into sections, then these sections are shaped during their conveyance to an adjacent discharge or processing station.

The invention also relates to an installation for carrying out the above-described method, characterized in that it comprises means for cutting the previously formed cellulose acetate rod, means for transferring the sections obtained and shaping means located in these transfer means.

BRIEF DESCRIPTION OF DRAWINGS

The accompanying drawings illustrate, as an example, one embodiment, as well as a variation of an installation for carrying out the method according to the invention.

FIG. 5 shows the profile of the filter after shaping as well as the profile of the shaping tools;

FIG. 6 is a sectional view on line VI—VI of FIG. 5;

FIG. 7 shows a variation of the profile of the filter and shaping tools;

FIG. 8 is a sectional view on line VIII—VIII of FIG. 7;

FIG. 9 shows four variations of cross sections of the filter and shaping tools;

DESCRIPTION OF PREFERRED EMBODIMENTS

Figure 12:
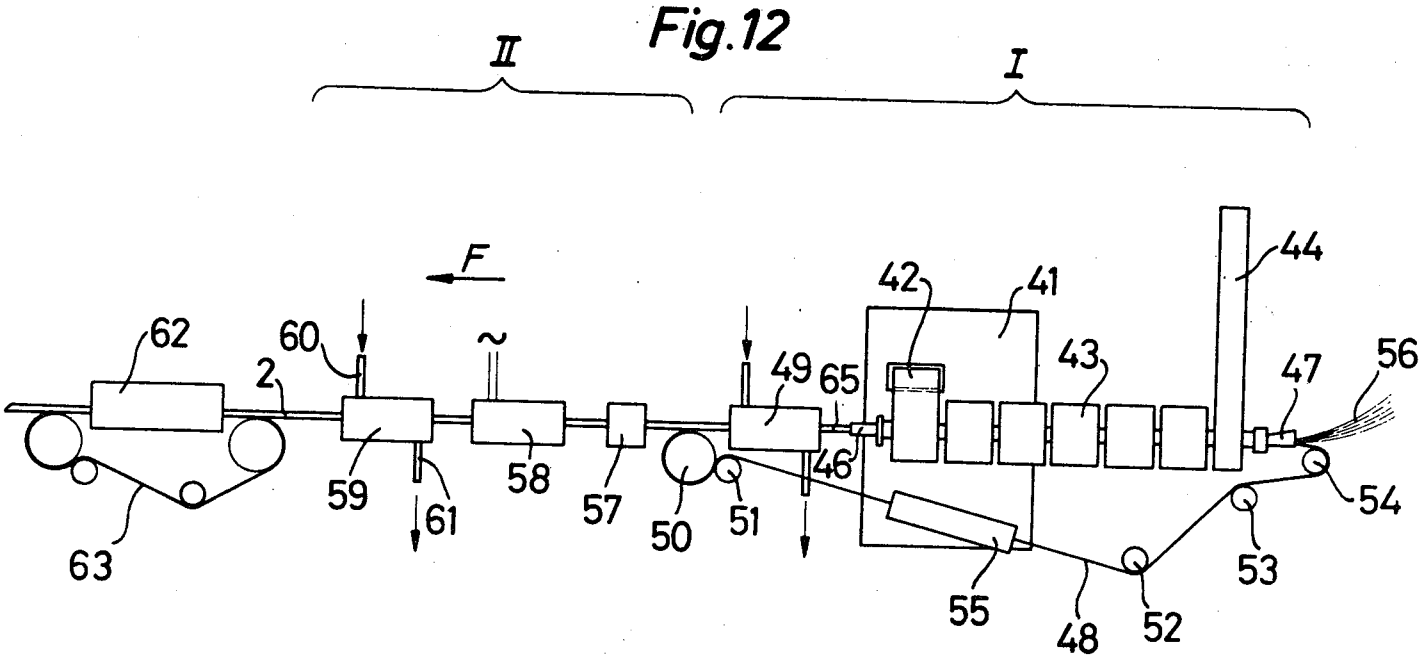
FIG. 12 is a schematic view of apparatus for forming a rod of celluslose acetate.

In FIG. 12 there is shown schematically apparatus for forming a rod of cellulose acetate impregnated with a plasticizing agent and having a porous skin or covering. The apparatus shown comprises basically two sections, a first section I in which a rod is formed out and a second section II in which a skin is formed on the rod and the final diameter of the rod determined.

Section I comprises hyperfrequency heating means such as are described in copending application No. 507,804 based on Swiss patent application No. 13675/73. These heating means include a high frequency generator 41 supplying, via a rectangular wave guide 42, five resonant cavities 43 connected in cascade, the last resonant cavity being coupled to a wave guide 44 terminated by a load impedance dissipating the energy not used by the hyperfrequency heating. The frequency used is preferably between 3000 MHz and 300,000 MHz. Through the resonant cavities 43 extends a tube 46 of a low permittivity material, such as polytetrafluorethylene or quartz. At the inlet of tube 46 is disposed a funnel 47 such as that described, for example, in U.S. Pat. No. 3,257,512. Through the funnel 47 and tube 46 passes a conveyor belt 48 which also extends through a first cooling chamber 49 including a tubular passage for belt 48. This first cooling chamber 49 may have means for circulating a cooling liquid or gas. The belt 48 is of a low permittivity material such as polytetrafluorethylene reinforced with glass fibres, for example that available under the trademark "FLUORGLAS." It is alternatively possible to use a material sold under the trademark "KEVLAR." The belt 48 is driven by a roller 50 and is supported and guided by rollers 51 to 54. As shown, it also passes through a cooling device 55, but this cooling device could possibly be dispensed with if the cooling in chamber 49 is sufficient. Section I is preceded by a first plastification chamber, not shown in the drawing, in which a bundle of fibres 56, for example of cellulose acetate, is covered with a heat-activable binder or plastifier, such as triacetin.

Section II comprises a second plastification chamber 57 followed by a superheating element 58 in the form of a block provided with a smooth cylindrical passage formed by a metal tube heated for example by electrical resistors, or alternatively by the circulation of a superheated liquid or gas such as steam. Section II also comprises a second cooling chamber 59 having a metal tube with a smooth inner wall identical to the tube of element 58, a cooling liquid circulating through chamber 59, entering by a pipe 60 and leaving by a pipe 61.

Section II is followed by a traction device 62, known per se, including a conveyor belt 63 for pulling the formed rod 2 of cellulose acetate.

The installation operates in the following manner: the fibres of bundle 56 are brought together in a tow driven by the belt 48 which, as it penetrates in tube 46, is wrapped around the two. This tow, driven by the belt 48 passes through the resonant cavities 43 in which it is heated so that the fibres of cellulose acetate weld point-by-point to one another in a manner to form a cord which leaves the tube 46 at 65, still wrapped in the belt 48. This cord leaves tube 46 at a high temperature and the points of welding the fibres are still soft so that the cord generally does not have a sufficient stength to be freed from the belt 48 while keeping its shape. In the first cooling chamber 49, the cord, still wrapped in the belt 48, is cooled to form a rod with approximately the final diameter of rod 2 and a sufficient rigidity to be pulled by the traction device 62 through the second plastification chamber 57 in which it is superficially coated with the same heat-activable or plastifier as before, the quantity of binder or plastifier deposited depending on the thickness of the skin it is desired to form. The rod then passes through the tube of the superheating element 58 whose inner diameter defines the diameter of rod 2, the surface of the rod being heated in contact with the tube to temperature such that it ensures activation of the binder or plastifier. The rod 2 then passes through the smooth tube of the second cooling chamber 59 in which it acquires its final and precise dimaeter. The rod 2 continues its movement in the direction of arrow F towards a cutting device, not shown, which sections the rod into non-enveloped filter tips.

Although the described installation is preferred, the described forced cooling chamber could be dispensed with, and the rod allowed to cool naturally in free air or in a current of cool air.

Instead of hyperfrequency heating device, it is of course possible to use other heating devices, for example a steam heating device, or high frequency, mixed steam/HF or steam/VHF devices.

It would be possible to use the belt 48 also as traction belt. However, the described arrangement is preferable since the special woven belt 48 lends itself to use as a traction belt.

The rod which is formed as described above is then cut into sections and shaped by the apparatus illustrated in FIGS. 1–11.

Figure 1:
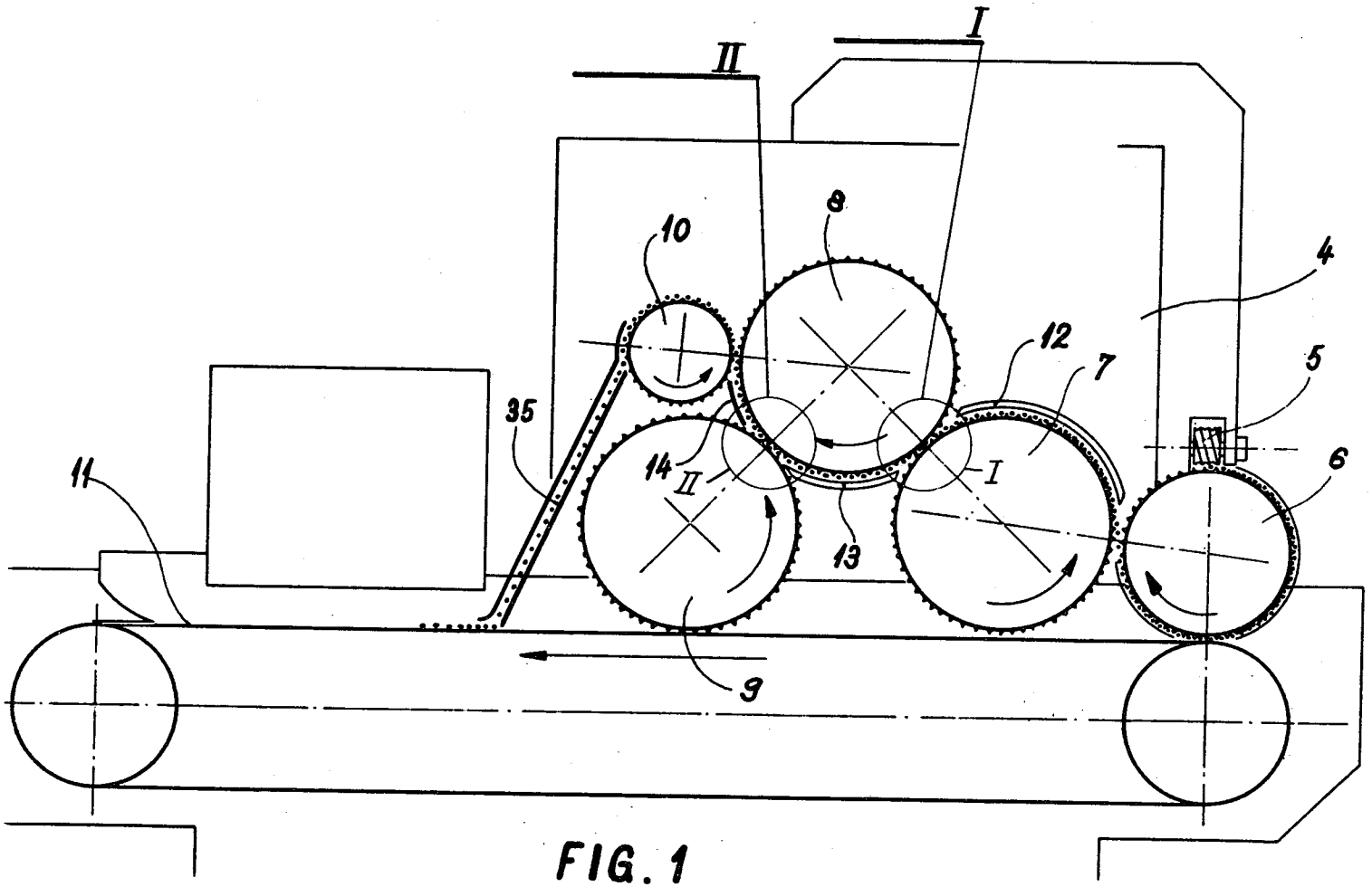
FIG. 1 is a diagrammatic elevational view of apparatus for use in making transverse-flow cigarette filters in accordance with the invention.
Figure 2:
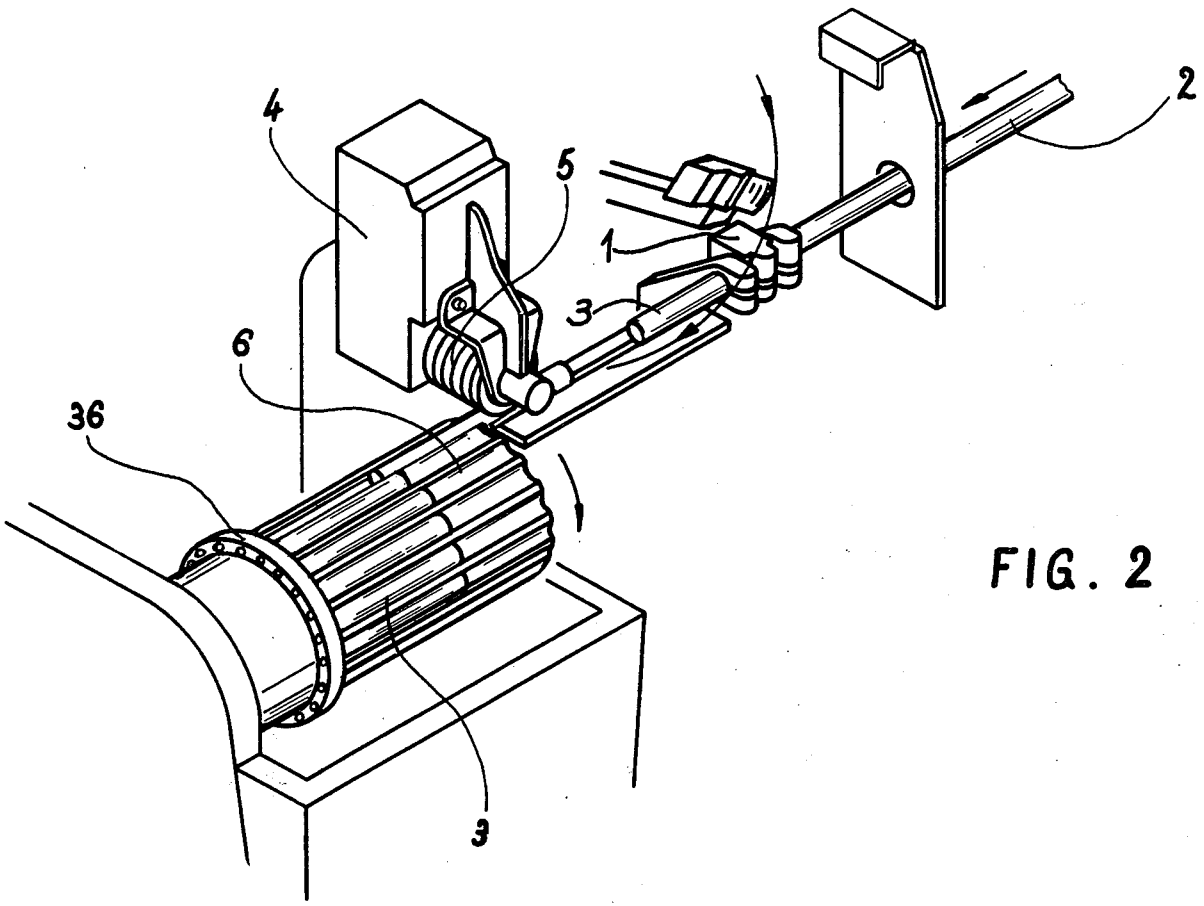
FIG. 2 is a perspective view of the inlet of the apparatus.

At its inlet, the installation shown in FIGS. 1 and 2 comprises essentially a cutting device 1 known per se, for dividing the rod 2 into sections. The cutting device 1 cuts the rod 2 into small rod sections 3 whose length corresponds to several lengths of filter, for example four or six lengths. The frame 4 supports a wheel 5 whose periphery comprises a helical groove whose axis coincides with the axis of the wheel 5. The wheel 5, also known as a helical spacer, rotates in the immediate vicinity of the grooves or channels of a first grooved drum 6 known as a deflector drum. This deflector drum 6 ensures the uniform and continuous distribution of smal rods 3. It comprises an annular edge 35 against which the small rods abut. A device of this type is described in detail in Swiss Patent No. 570,320 so that its description will not be repeated again in detail. As regards the helical spacer 5, which does not appear in the device described in Swiss Patent No. 570,320, its function is to facilitate the transformation of the longitudinal movement of the small rods 3 into a transverse movement resulting from their entrainment by the grooves of the deflector drum 6.

The shaping device is constituted by a first grooved drum 7 constituting a counter punch, a second grooved drum 8 constituting a second punch. The installation also comprises a grooved transfer drum 10 on which the small shaped rods are retained by vacuum as on the drum 6. This drum 10 is a simple transfer drum on which these small rods are retained by vacuum, then released at the end of approximately half a revolution in the same manner as on the drum 6, as described in Swiss Patent No. 570,320. The installation also comprises a discharge chute 35 leading to a conveyor belt 11 for the discharge of the small rods to a packing device or another machine in the case where the filtering members are introduced into composite filters. The moving parts 5 to 10 are integral with gears which are not shown, by which they are set in simultaneous and synchronous rotation. In addition to their shaping function, i.e. their role as punches, the drums 8 and 9 ensure the transfer of the small rods, in the same way as the drums 6, 7 and 10 and this constitutes one of the original features of the device. On the drums 7 and 8, the small rods are not retained by vacuum, but by deflecting plates 12, 13 and 14 following the circumference of the drums.

Figure 3:
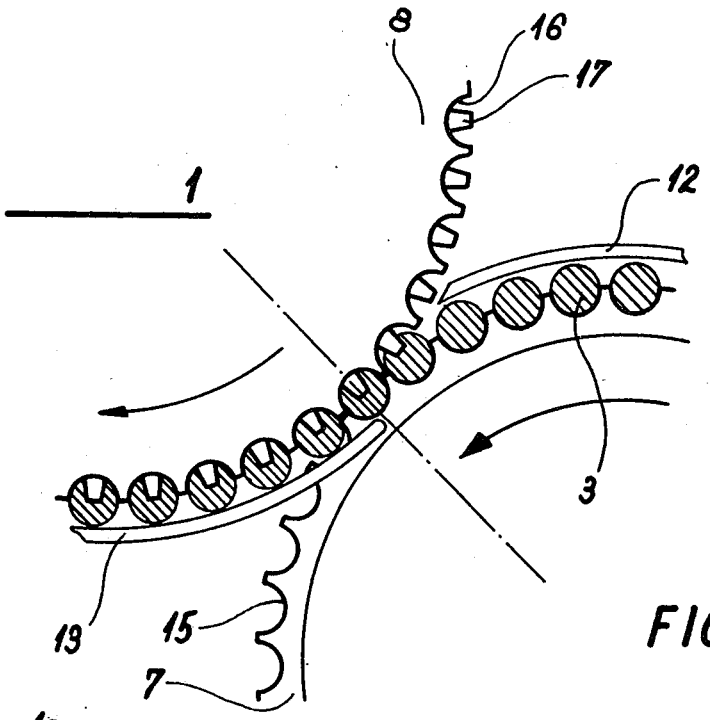
FIG. 3 shows a detail of the parts of a first shaping stage.
Figure 4:
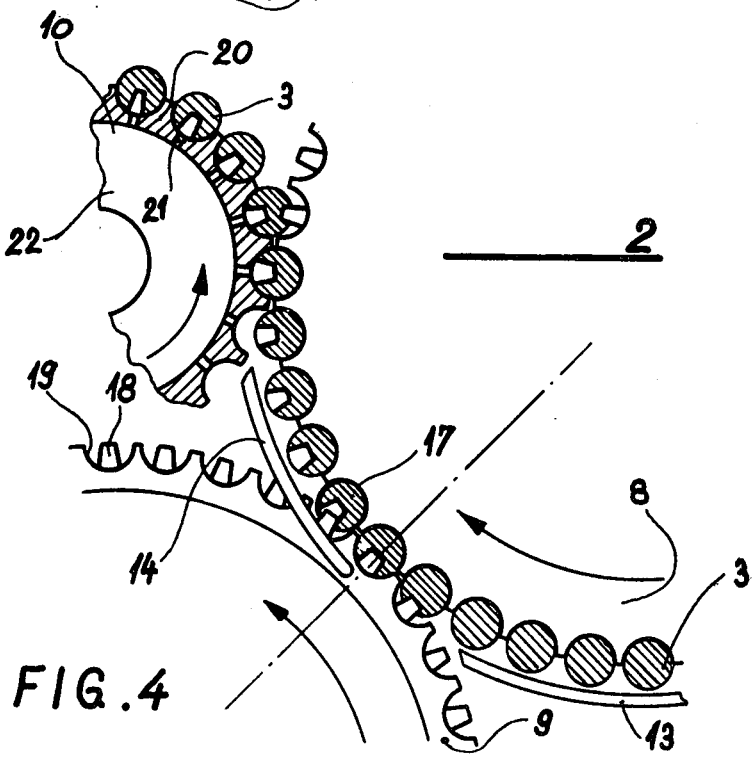
FIG. 4 shows a detail of the parts of a second shaping stage.

Owing to the method of shaping on rotating parts, the shaping process necessarily takes place in two stages, in two areas indicated by the circles I and II. These shaping areas are shown in detail in FIGS. 3 and 4 respectively. FIG. 3 shows that the grooves 15 of the drum 7 have an approximately semi-cylindrical profile over their entire length, whereas the grooves 16 of the drum 8 comprise projections 17. Depending on the direction of the groove, the longitudinal profile of these projections may have the shape shown in FIG. 5 for example. There are four projections, namely **17*a*, 17*b*, 17*c* and 17*d*. Since the grooves 15 are smooth, the projections 17*a* to 17*d* may occupy any position with respect to the grooves 15. On the other hand, in stage II shown in FIG. 4, these projections 17 should have a shape interacting with that of the projections 18, the shapes of which are similar to those of the projections 17, provided in the grooves 19 of the drum 9. The shape and position of the projections 18 with respect to the position of the projections 17 is visible in FIG. 5 where it can be seen that there are three projections 18*a*, 18*b* and 18*c* per groove. The section lines III—III and IV—IV correspond respectively to FIGS. 3 and 4. Both in stage I as well as stage II, it is necessary as shown in FIGS. 3 and 4, that the grooves 15 and 16 on the one hand and the grooves 16 and 19 on the other hand are exactly opposite each other when the grooved drums come into approximate tangential contact one with the other. This condition of coincidence is naturally valid for the drums 6 and 10. FIG. 4 also shows that holes 21 are provided through the casing 20 of the drum 10, which holes communicate with an inner chamber 22 in which reduced pressure prevails sufficient to keep the shaped rods 3 on the transfer drum 10. Instead of being retained by reduced pressure, it is naturally also possible to use plates similar to the plates 12 to 14**, but since the technique of retention by reduced pressure is known and has been completely mastered, this solution proves simple and effective.

The installation operates in the following manner: After cutting into sections at 1, the small rods 3 obtained are transferred to the groove drum 6 by means of the helical spacer 5. The direction of rotation of the drums 6 to 10 is indicated by the arrows. The small rods 3 are then transferred to the drum 7 at the point of contact of these two first drums. When the rods arrive opposite the drum 8, they are engaged between these two drums and undergo a first shaping operation corresponding to the profile 17*a* to 17*d*. They are then entrained by the drum 8 in order to be engaged between the drums 8 and 9 where they undergo a second shaping operation according to the profile 18*a* to 18*c*. The shaped rods are then discharged by the drum 10 and the conveyor belt 11. At this time, the rod has the shape shown in FIG. 5. It may subsequently be cut into six filter members 23, 24, 25, 26, 27 and 28. FIG. 6 shows the shape of the end of the filter 26, in end view. When one of these filtering members, for example the member 26 is surrounded by a cylindrical casing, it forms an oblique separation between two chambers corresponding to the impressions 17*a*, 18*a*.

The profile and section shown in FIGS. 5 and 6 are in no way limiting. Numerous other shapes may be obtained in the same way.

FIGS. 7 and 8 show another profile and another section, by way of example. As seen in FIG. 7 the indentations formed in one side of the rod are offset longitudinally of the rod relative to the indentations in the opposite side of the rod.

FIG. 9 shows four variations of cross sections at the end of a filter, by way of example. For the same profile, it is possible to have different cross sections.

With this method, it is not only no longer necessary to synchronise the cut with the stamped profile, but positioning of the rods in the shaping tools is ensured automatically by the positioning of these rods on the transfer drums, this positioning being effected on the first drum 6 when the rods 3 abut against the annular edge 36 of this drum.

In view of the fact that cellulose acetate is shaped during its hardening time, the method used also has another important advantage. In fact it is possible to increase the time during which the rods remain in the shaping tools, i.e. the hardening time, by increasing the diameter of the drums without reducing the operating speed, i.e. the feed of the continuous rod and the small shaped rods.

Instead of heating the rod prior to the cut, or in addition to this heating, it is possible to heat the punches, for example by means of electrical resistances.

Figure 10:
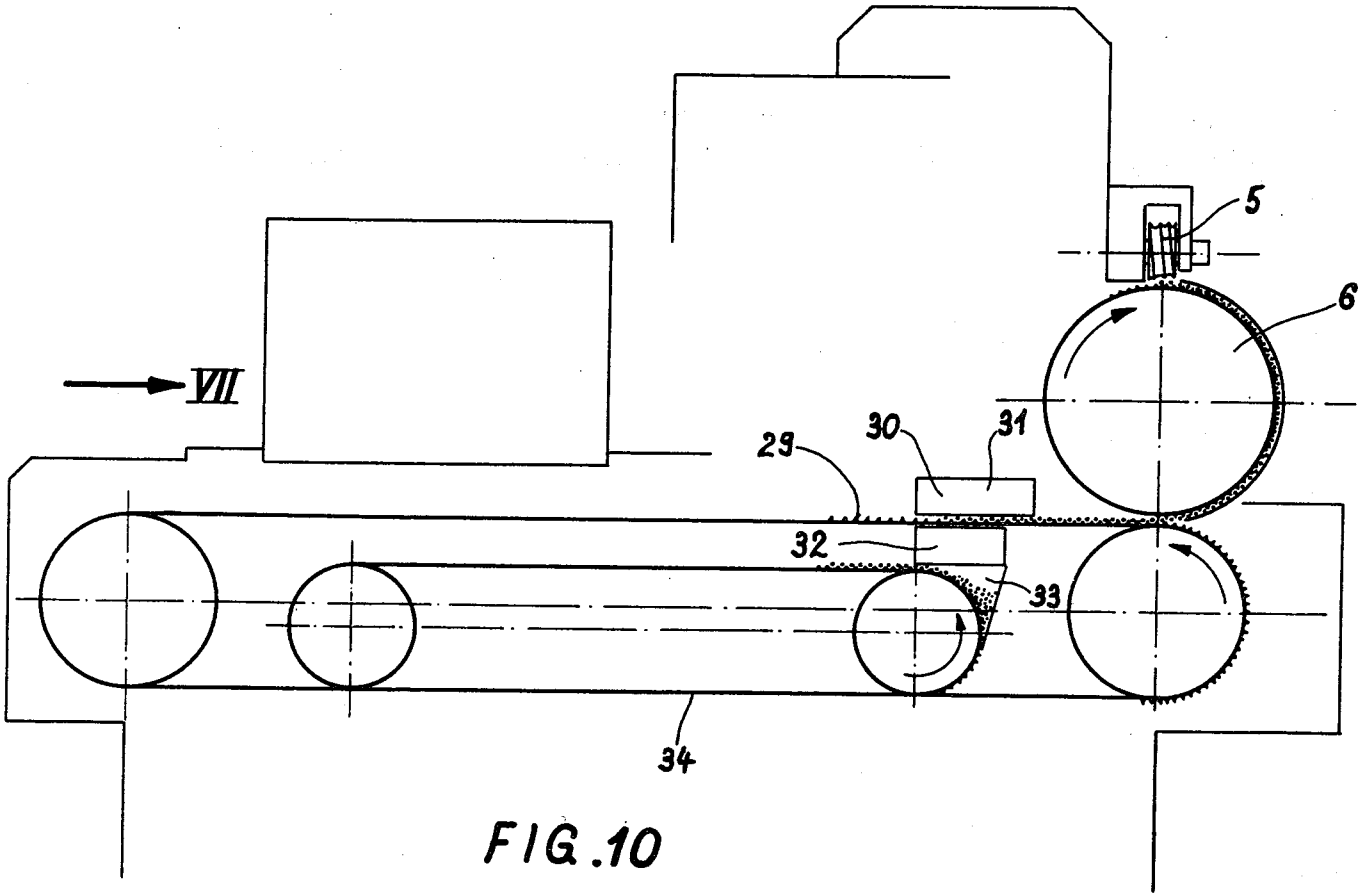
FIG. 10 is a diagrammatic side elevational view of a variation.
Figure 11:
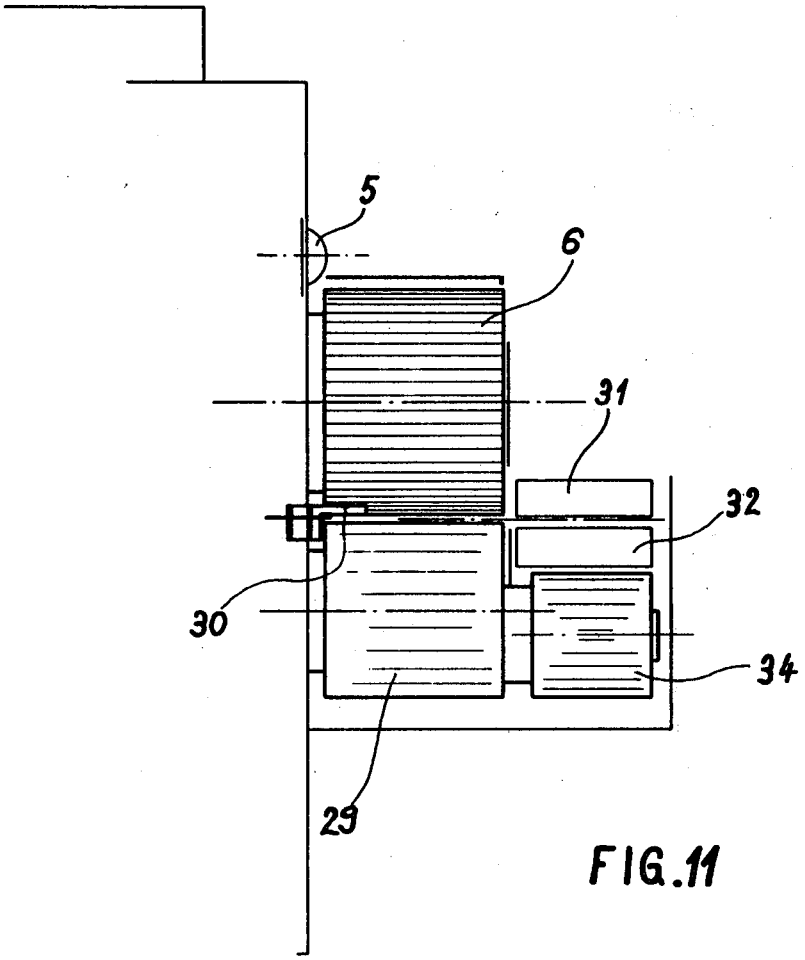
FIG. 11 shows a view of this variation in direction A.

In the embodiment illustrated as a variation in FIGS. 10 and 11, shaping does not take place between two rollers, but the rods are transferred from the deflector drum 6 to a conveyor belt 29 provided with transverse grooves, from which they are driven laterally by means of a compressed air jet 30 between two punches 31 and 32 carrying out a vertical alternating movement. The shaped rod then falls into a hopper 33 leading to a second endless conveyor belt 34 also provided with transverse grooves ensuring an orderly transfer of rods to the next station. If the progress of the rods takes place in a continuous manner on the drum 6 and on the conveyor belts 29 and 34, shaping between the punches 31 and 32 necessarily takes place discontinuously. To this end, the rods are driven periodically in groups from the belt 29 between the punches 31 and 32.

According to a variation which is not shown but very close to the preceding embodiment, the rods are also driven laterally in large groups between two relatively long punches which then ensure their direct transfer to a magazine or package.

Figure 13:
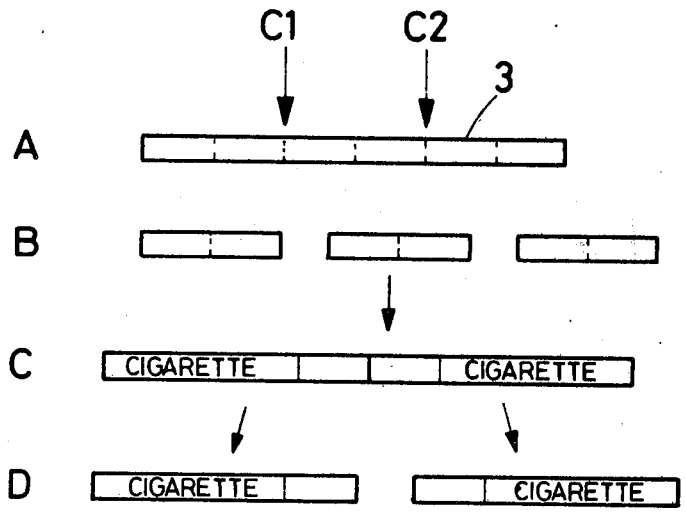
FIG. 13 is a flow chart illustrating division of the rod sections and applications of filters to cigarettes.

The rod sections 3 are subdivided and applied to cigarettes as illustrated schematically in FIG. 13. A rod section 3 is shown schematically as being of a length to provide six individual filters. The rod section is first cut at points C1 and C2 as indicated at A so as to divide it into three parts each of double filter length as illustrated at B. Such double filter is then placed between two cigarettes as illustrated at C and joined at opposite ends to the cigarettes in known manner, for example by a band of paper. The double filter is then out at point C3 to provide single length filters each attached to a cigarette. The position of the cut with respect to indentations in the rod section is indicated by transverse lines in FIGS. 5 and 7.

While a preferred embodiment of the invention has been illustrated in the drawings and is herein particularly described, it will be understood that modifications and variations may be made and that hence the invention is in no way limited to the illustrated embodiments.

What is claimed is:

1. Apparatus for making transverse flow cigarette filters which comprises:

means for forming cellulose acetate previously impregnated with a plasticizing agent into a rod having a porous covering:

means for cutting said rod at a cutting station into sections each having a length of several filters;

means for conveying said rod sections from said cutting station in a direction transverse to the lengths of said rod sections; and means engaging opposite ends of said rod sections for positioning said rod sections while being thus conveyed, said conveying means comprising a revolving drum having in its peripheral surface a plurality of longitudinal grooves into which said rod sections are fed and by which they are conveyed as said drum revolves, and a second revolving drum having in its peripheral surface longitudinal grooves into which said rod sections are transferred, said second drum having in its groove spaced projections for forming longitudinally spaced indentations in one side of each of said rod sections while said sections are being conveyed by said conveying means from said cutting station.

2. Apparatus according to claim 1, further comprising a third revolving drum having on its periphery projections engaging said rod sections while carried by said second revolving drum to from indentations in diametrically opposite sides of said rod sections.

3. Apparatus according to claim 2, further comprising a fourth revolving drum having in its peripheral surface longitudinal grooves for receiving said rod sections from said second revolving drum, said fourth revolving drum having means for applying suction to transfer said rod sections from grooves in said second revolving drum to grooves in said fourth revolving drum.

4. Apparatus according to claim 1 in which said projections on said third drum for forming indentations in the opposite side of said rod sections are positioned to form indentations which are offset longitudinally of said rod sections relative to indentations formed by said projections in grooves of said second drum.

5. Apparatus for making transverse-flow cigarette filters which comprise:

means for forming cellulose acetate previously impregnated with a plasticizing agent into a rod having a porous covering;

means for cutting said rod at a cutting station into sections each having a length of several filters;

means for conveying said rod sections from said cutting sation in a direction transverse to the lengths of said rod sections;

means engaging opposite ends of said rod sections for positioning said rod sections while being thus conveyed; and means for forming longitudinally spaced indentations in opposite sides of said rod sections intermediate their ends while said sections are being conveyed by said conveying means from said cutting station;

said conveying means comprising a conveyor belt having transverse grooves into which said rod sections are fed and by which they are conveyed in a direction transverse to their lengths.

6. Apparatus according to claim 5, in which said means for forming indentations in opposite sides of said rod sections comprises opposed punches between which said rod sections are transferred from grooves in said conveyor belt.

7. Apparatus according to claim 6, in which said conveyor belt moves continuously and in which groups of said rod sections are transferred intermittently from grooves in said conveyor belt to a position between said punches.

8. Apparatus according to claim 7, comprising a hopper into which said rod sections drop after being indented, and a second conveyor belt with transverse grooves for conveying and indented rod sections from said hopper.

9. In apparatus for making tranverse-flow cigarette filters the combination of:

means for cutting a continuous rod of cellulose acetate impregnated with a plasticizing agent and having a porous covering into sections each having a length of more than two filters, means for conveying said rod sections from said cutting means in a direction transverse to the lengths of said rod sections, means engaging opposite ends of said rod sections for positioning them while being conveyed, and means engaging said rod sections in a direction transverse to their length to form spaced identations in opposite sides of said rod sections intermediate their ends while said sections are being conveyed by said conveying means from said cutting means, said conveying means comprising a revolving drum having in its periphery longitudinal grooves in which said rod sections are received and by which they are conveyed as the drum revolves, said indentation forming means comprising spaced projections in said grooves for forming indentations in one side of each of said rod sections.

10. Apparatus according to claim 9, in which said indenting means further comprises a second revolving drum having on its periphery projection engaging rod sections carried by said first mentioned revolving drum to form indentations in opposite sides of said rod sections offset longitudinally of said rod sections from indentations formed in said one side.

11. Apparatus for making transverse-flow cigarette filters comprising:

means for cutting a continuous rod of cellulose acetate impregnated with a plasticizing agent and having a porous covering into sections each having a length of several filters, means for conveying said rod sections from said cutting means in a direction transverse to the lengths of said rod sections, means engaging oppoiste ends of said rod sections for positioning them longitudinally while being thus conveyed, and means for forming longitudinally spaced indentations in opposite sides of each of said rod sections intermediate its ends while being conveyed by said conveying means, said indentation forming means comprising first means for forming spaced indentations in a first side of each of said rod sections and second means for forming in the opposite side of each of said rod sections spaced indentations which are offset longitudinally of said rod sections relative to said indentations in said first side of each of said rod sections so as to be opposite spaces between said indentations formed in said first side.

* * * * *